United States Patent [19]

Müller

[11] 4,397,339

[45] Aug. 9, 1983

[54] DEVICE FOR REMOVING CONTAMINATING MATTER IN JACQUARD WEAVING MACHINES

[75] Inventor: Ernst Müller, Wädenswil, Switzerland

[73] Assignee: Gessner AG, Wädenswil, Switzerland

[21] Appl. No.: 293,406

[22] Filed: Aug. 14, 1981

[30] Foreign Application Priority Data

Aug. 22, 1980 [CH] Switzerland ..... 6361/80

[51] Int. Cl.[3] ..... D03D 00/00

[52] U.S. Cl. ..... 139/1 C

[58] Field of Search ..... 139/1 C; 57/304; 15/306 A, 405

[56] References Cited

U.S. PATENT DOCUMENTS 3,491,801 1/1970 Lippuner ..... 139/1 C

FOREIGN PATENT DOCUMENTS 584302 1/1977 Switzerland ..... 139/1 C 2027878 2/1980 United Kingdom ..... 139/1 C

*Primary Examiner*—Henry Jaudon

*Attorney, Agent, or Firm*—Toren, McGeady and Stanger

[57] ABSTRACT

To prevent the accumulation of contaminating matter in the harness of a Jacquard weaving machine, a perforated box is provided at the lower end of the harness. Air is supplied into the box so that it flows vertically upwardly along the harness members and prevents dust, fibers and other contaminating matter from settling on the harness.

7 Claims, 1 Drawing Figure

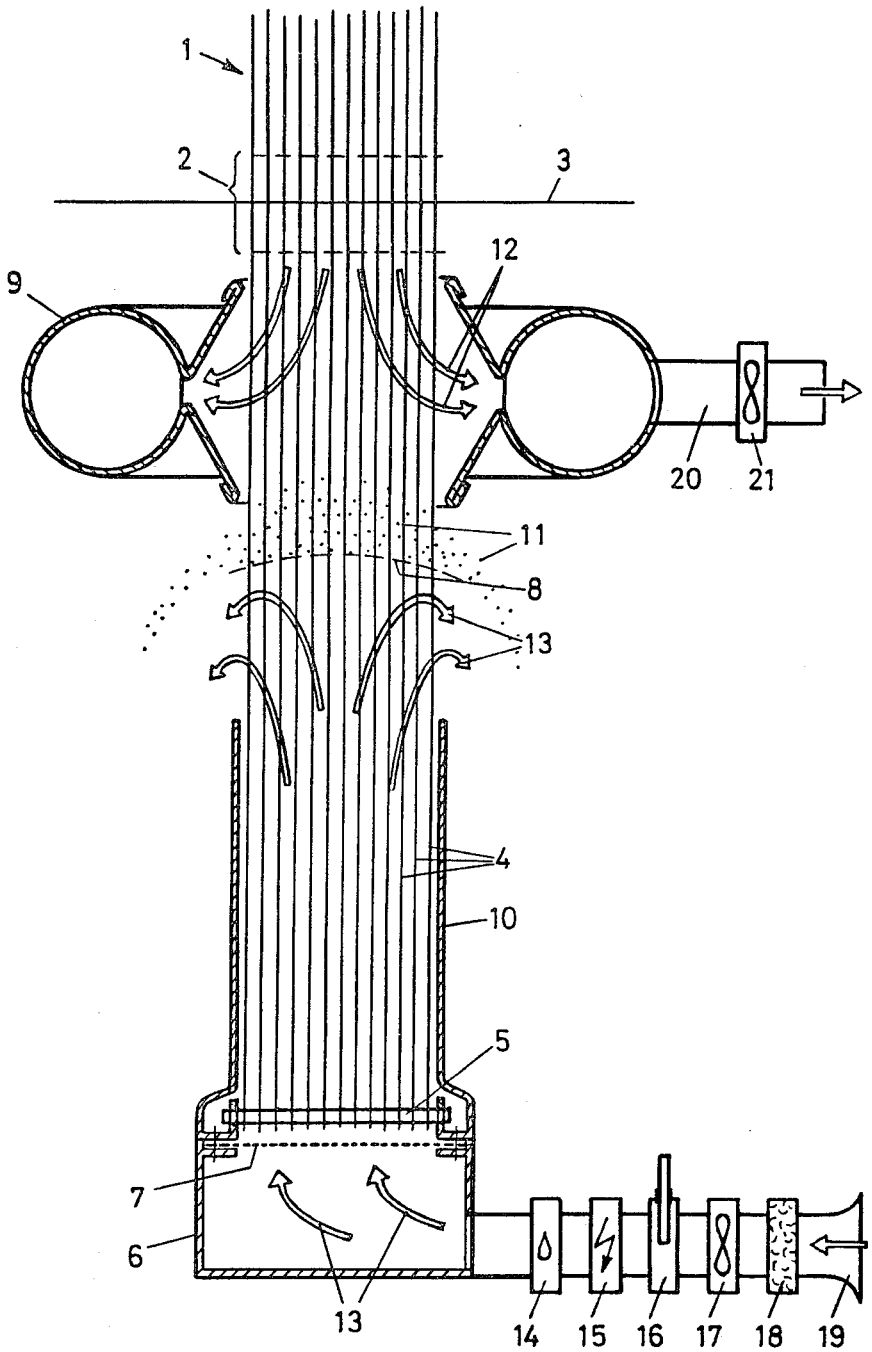
1
2
3
9
12
20
21
11
8
13
4
10
5
7
6
13
14
15
16
17
18
19

DEVICE FOR REMOVING CONTAMINATING MATTER IN JACQUARD WEAVING MACHINES

SUMMARY OF THE INVENTION

The present invention is directed to a device for preventing the accumulation of contaminating matter in a Jacquard weaving machine and, more particularly, it is directed to a device incorporated into the harness of the weaving machine.

For years there has been a problem in Jacquard weaving machines of the accumulation of contaminating matter on the members in the lower area of the weaving harness. During the weaving process, air-borne fibers, dust, waste from the fibers being woven are deposited in this area. The accumulated contaminating matter slides downwardly on the harness and becomes matted. As a result, the harness members rot and break. This problem also has an adverse effect on the quality of the cloth being woven and, further, the weaving harness may eventually be destroyed. The harness must be replaced periodically, in certain cases every six months, with the result that the weaving machine must be taken out of service.

With the development of higher speed weaving machines, running at about 250 r.p.m., the accumulation of contaminating matter is significantly increased. Moreover, in addition to the higher speed, there are greater working widths of the machines, accordingly, more harness members (from 6,000 to 20,000), so that the accumulation of contaminating matter causes disproportionately high costs.

It has been known to clean the weaving machine by blowing dust several times a day in the sideward direction out of the harness by means of a hand blower. This procedure, however, does not remove matted fiber parts which must be periodically removed mechanically. Further, blowing out the dust tends to foul the environment around the machine making the working conditions unsatisfactory.

In another attempt to remove the contaminating matter, large suction fans have been placed alongside the harness to clean the Jacquard weaving machine as soon as the contaminating matter appears. The effectiveness of this arrangement requires a high degree of suction with a resultant significant energy consumption.

The primary object of the present invention is to provide a device for the removal of contaminating matter in Jacquard weaving machines where the above-mentioned drawbacks are overcome. In accordance with the present invention, a device is formed as part of the harness for the weaving machine so that air is directed upwardly along the harness members.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWING

In the drawing a schematic representation is provided of the lower part of a Jacquard weaving harness.

DETAILED DESCRIPTION OF THE INVENTION

In the drawing a Jacquard weaving harness 1 is shown extending downwardly below the warp 3. In the region of the warp 3 and of the shed there is a zone 2 in which contaminating matter occurs during the weaving process. Such contaminating matter may be in the form of air-borne fibers, waste fibers from the cloth being woven and dust. As the contaminating matter accumulates it slides down along the harness members 4 and, if the matter is not timely removed, it can form a mat on the harness. In high performance weaving machines, harness members 4 are frequently used which are made of elastic synthetic fiber cords on which there is a greater tendency for the contaminating matter to adhere because of electrostatic forces. Such electrostatic forces make it more difficult to remove the contaminating matter.

At the lower end of the harness 1 where an attachment 5 is provided for the harness members 4, a box 6 is provided into which air is supplied by a blower 17 with the air flowing into the box 6 through an air duct 19. A perforated metal sheet 7 extends across the upper side of the box 6 and the air flows in a uniform manner upwardly along the members 4 of the harness 1 so that a slight excess pressure exists along the lower part of the harness. With this arrangement a uniform vertical air flow occurs over the lower part of the harness. The level of this "air cushion" is shown in the drawing by the broken line 8. The slight excess pressure acting upwardly along the harness members 4 prevents the downward flow of the contaminating matter and it is displaced sideways and carried off by the air flow note the arrows 13. Care must be taken, however, that the vertical air flow does not interfere with the weaving process, accordingly, a slide valve 16 in duct 19 adjusts the level 8 of the "air cushion." The air introduced into the box 6 is adequately filtered by employing a filter 18. To prevent electrostatic charging of the fibers, the air introduced is humidified in a humidifier 14 or ionized in an ionizer 15. The blower 17 and slide valve 16 can provide a flow of air over the harness members 4 at a speed of 3 to 5 meters per second.

Due to the upward flow of air along the harness members 4 there is an accumulation of air-borne dust 11 at the level 8 of the air cushion below the warp 3 with the underside of the warp being burdened with air-borne fibers. To counteract this phenomenon, it is preferable to position suction pipes 9 at both sides of the harness below the shed. These pipes 9 draw in the fibers and discharge them into the air or to a dust filtration apparatus, note the direction of the arrows 12 showing the downwardly flow of air from the warp 3. Furthermore, the suction pipes 9 also prevent any accumulation of dust in the vicinity of the weaving machine. The suction action of the pipes 9 is effected via an air duct 20 connected to the pipes and a suction blower 21 located in the air duct.

Another improvement of this apparatus involves the placement of a casing 10 around the lower part of the harness 1 to improve the channeling of the air flow upwardly along the harness members 4.

While specific embodiments of the invention have been shown and described in detail to illustrate the application of the inventive principles, it will be understood that the invention may be embodied otherwise without departing from such principles.

I claim:

1. Device for the removal of dust, air-borne fibers, waste fibers and other contaminating matter in a Jacquard weaving machine having a warp, wherein the device comprises a generally vertically extending elastic weaving harness means extending downwardly from the warp, means located at the lower end of the harness means for directing a flow of air upwardly over said harness means, and means for controlling the flow of air through said means for directing a flow of air upwardly for establishing an air cushion having an upper level spaced below the warp for keeping contaminating matter out of the lower part of said harness means.

2. Device, as set forth in claim 1, wherein said harness means includes an attachment member at the lower end thereof, elastic harness members secured to said attachment member and extending upwardly therefrom, a box located at the lower end of said harness means below said attachment member, said box having a perforated surface directed upwardly toward said attachment member so that air introduced into said box flows through said perforated plate upwardly along said harness members.

3. Device, as set forth in claim 1, wherein suction means are located along opposite sides of said vertically extending means below the location of the warp in the weaving machine and above the lower part of said harness means for suctioning off contaminating matter below the warp so that the contaminating matter does not enter the lower part of said harness means.

4. Device, as set forth in claim 2, including a casing located around the lower end of said harness members and extending upwardly from said attachment member for channelling air from said means for directing a flow of air over said harness members.

5. Device, as set forth in claim 2, wherein said means for controlling the flow of air includes at least one of a humidifier and an ionizer for the air introduced into said box.

6. Device, as set forth in claim 2, wherein said means for controlling the flow of air includes means for providing a flow of air moving over said harness members at a speed of 3 to 5 meters per second.

7. Device, as set forth in claim 6, wherein said means for providing a flow of air include an air duct connected to said box, and a blower within said air duct for introducing air under pressure into said box.

* * * * *